US005943695A

United States Patent [19]

Yen

[11] Patent Number: 5,943,695

[45] Date of Patent: Aug. 31, 1999

[54] LIMB GUARD HAVING A ONE-PIECE SHOCK ABSORBING MEMBER WITH DIFFERENT THICKNESS SECTIONS

[75] Inventor: Dale Yen, Taipei Hsien, Taiwan

[73] Assignee: Comax Sporting Goods Co., Ltd., Taipei, Taiwan

[21] Appl. No.: 09/012,768

[22] Filed: Jan. 23, 1998

[51] Int. Cl.[6] ..... A41D 13/00

[52] U.S. Cl. ..... 2/22; 2/16

[58] Field of Search ..... 2/455, 16, 22, 2/23, 24

[56] References Cited

U.S. PATENT DOCUMENTS

| | | | |
|---|---|---|---|
| 4,756,026 | 7/1988 | Pierce, Jr. | 2/16 |
| 5,570,470 | 11/1996 | Miller | 2/22 |
| 5,625,896 | 5/1997 | LaBarbera et al. | 2/22 |
| 5,717,996 | 2/1998 | Feldmann | 2/22 |
| 5,784,715 | 7/1998 | Buchanan | 2/22 |

*Primary Examiner*—Michael A. Neas

*Attorney, Agent, or Firm*—Panitch Schwarze Jacobs & Nadel, P.C.

[57] ABSTRACT

A limb guard serves to protect a part of a limb from an external impact force and includes an elongate pad member, an elongate sheet layer mounted on the pad member to form an accommodation space between the elongate sheet layer and the elongate pad member, and a one-piece resilient impact absorbing member. The shock absorbing member is inserted in the accommodation space, and has a longitudinally extending central section of a first thickness adapted to resist and consequently absorb the external impact force applied thereon, and two lateral wing sections which are integrally formed with and which extend laterally from two longitudinal edges of the central section. Each of the lateral wing sections has a second thickness smaller than the first thickness to form a flexing juncture between the central section and each of the lateral wing sections so that each of the lateral wing sections can flex toward the part of the limb relative to the central section along a corresponding one of the flexing junctures to conform with and fit the contour of the part of the limb.

4 Claims, 5 Drawing Sheets

LIMB GUARD HAVING A ONE-PIECE SHOCK ABSORBING MEMBER WITH DIFFERENT THICKNESS SECTIONS

BACKGROUND OF THE INVENTION

1. Field of the Invention

The invention relates to a limb guard for protecting a part of a limb, more particularly to a limb guard which includes a one-piece impact absorbing member with lateral wing sections of a thickness smaller than that of a central section thereof such that each of the lateral wing sections can flex toward the part of the limb relative to the central section to conform with and fit the contour of the part of the limb.

2. Description of the Related Art

Referring to FIG. 1, a first conventional limb guard for protecting a part of a limb from an external impact force is shown to include an elongate pad member 13 and a one-piece resilient impact absorbing member 15.

As illustrated, the pad member 13, which is made from a soft and flexible material, includes an abutment inner layer 130 adapted to be wrapped around a part of a limb in a lengthwise direction of the limb to shield the latter, and a cushion outer layer 131 stitched to the inner layer 130 to form a receiving space for accommodating the impact absorbing member 15 such that the latter can absorb the external impact force applied on the pad member 13. The impact absorbing member 15 is substantially curved, and includes a longitudinally extending central section 150, and two lateral wing sections 151 which are integrally formed with and which extend laterally from two longitudinal edges of the central section 150 so as to define a flexing juncture between the central section 150 and each of the lateral wing sections 151 such that the lateral wing sections 151 are capable of bending relative to the central section 150. In order to resist and consequently absorb an external impact force, the impact absorbing member 15 is formed to have a uniform thickness throughout the entire length thereof. As such, the flexibility of the impact absorbing member 15 is limited. As a result, the lateral wing sections 151 are not capable of bending sufficiently relative to the central section 150 to match the contour of the part of the limb.

A second conventional limb guard has been proposed to obviate the above-mentioned drawback. As shown in FIG. 2, the pad member 10 is formed as a carrying bag with a plurality of elongate compartments 11 which extend in a lengthwise of the limb upon which the pad member 10 is to be fastened. The impact absorbing member includes a plurality of impact absorbing elements 12 received in the elongate compartments 11 respectively in such a manner that the second conventional limb guard can provide sufficient flexibility to fit the contour of the user's limb. However, a plurality of columns of clearances are formed between adjacent ones of the impact absorbing elements 12 along the stitch lines 102 of the pad member 10, thereby resulting in unsatisfactory protection from the external impact force.

SUMMARY OF THE INVENTION

The object of this invention is to provide a limb guard for protecting a part of a limb from an external impact force and which includes a one-piece impact absorbing member having lateral wing sections of a thickness smaller than that of a central section thereof, thereby providing an enhanced flexibility to conform with and fit the contour of a user's limb.

Accordingly, the limb guard of this invention is used to protect a part of a limb from an external impact force and includes an elongate pad member, an elongate sheet layer, and a resilient impact absorbing member of one-piece structure. The elongate pad member is adapted to shield the part of the limb, and is adapted to extend in a lengthwise direction of the part of the limb. The pad member has a rear surface adapted to face the part of the limb, and a front surface. The elongate sheet layer is attached to the elongate pad member at two longitudinal lateral end portions thereof so as to define an accommodation space between the elongate sheet layer and the elongate pad member. The shock absorbing member is inserted in the accommodation space, and has a longitudinally extending central section of a first thickness adapted to resist and consequently absorb the external impact force applied thereon, and two lateral wing sections which are integrally formed with and which extend laterally from two longitudinal edges of the central section. Each of the lateral wing sections has a second thickness smaller than the first thickness to form a flexing juncture between the central section and each of the lateral wing sections so that each of the lateral wing sections is adapted to flex toward the part of the limb relative to the central section along a corresponding one of the flexing junctures to conform with and fit the contour of the part of the limb.

BRIEF DESCRIPTION OF THE DRAWINGS

Other features and advantages of this invention will become more apparent in the following detailed description of the preferred embodiment with reference to the accompanying drawings, in which.

DETAILED DESCRIPTION OF THE PREFERRED EMBODIMENTS

Figure 1:
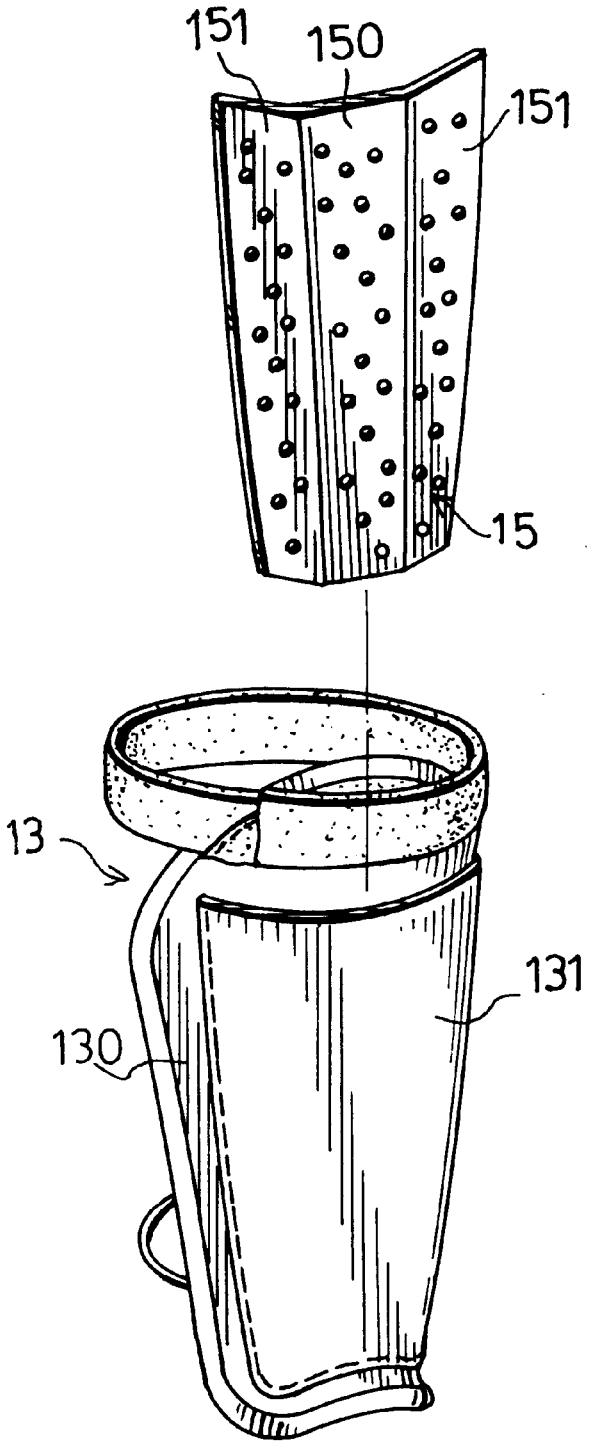
FIG. 1 PRIOR ART
FIG. 1 is a perspective view of a first conventional limb guard, illustrating a state prior to inserting an impact absorbing member into a pad member for fastening around a part of a limb.
Figure 2:
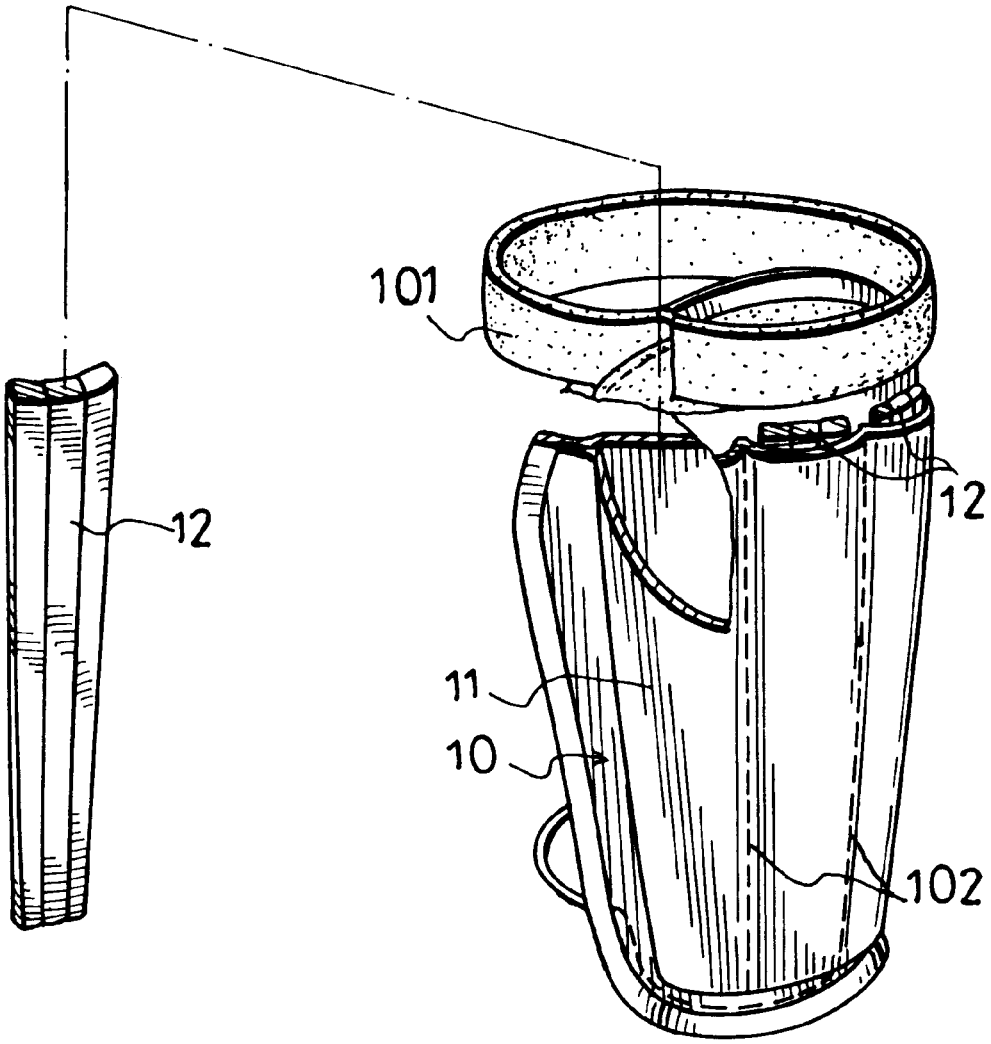
FIG. 2 PRIOR ART
FIG. 2 is a perspective view of a second conventional limb guard, wherein one of the impact absorbing elements is removed from a carrying bag for the sake of clarity.
Figure 3:
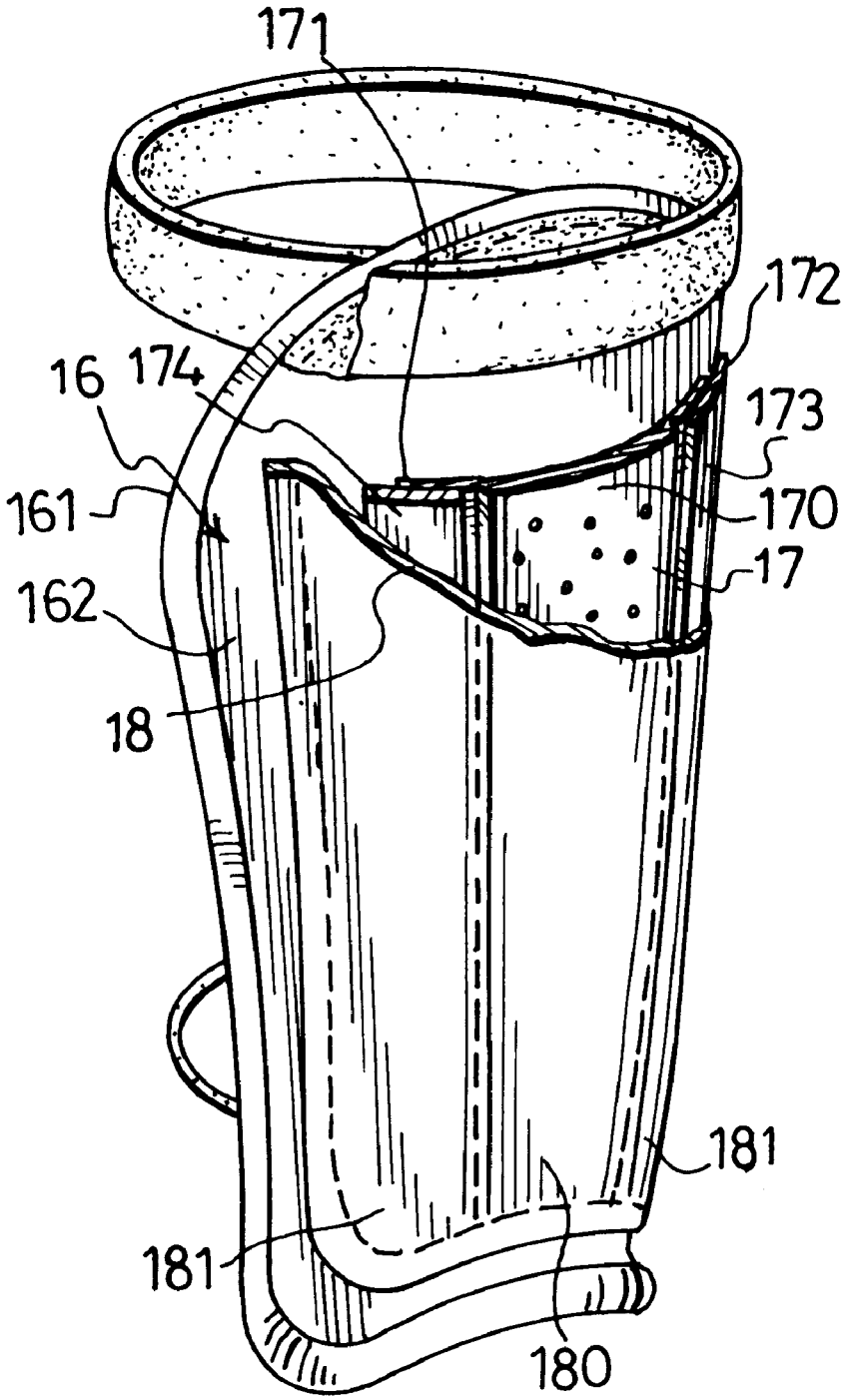
FIG. 3 is a schematic, perspective view a preferred embodiment of a limb guard according to this invention, wherein the preferred embodiment is partially cut-away to show the interior thereof.
Figure 4:
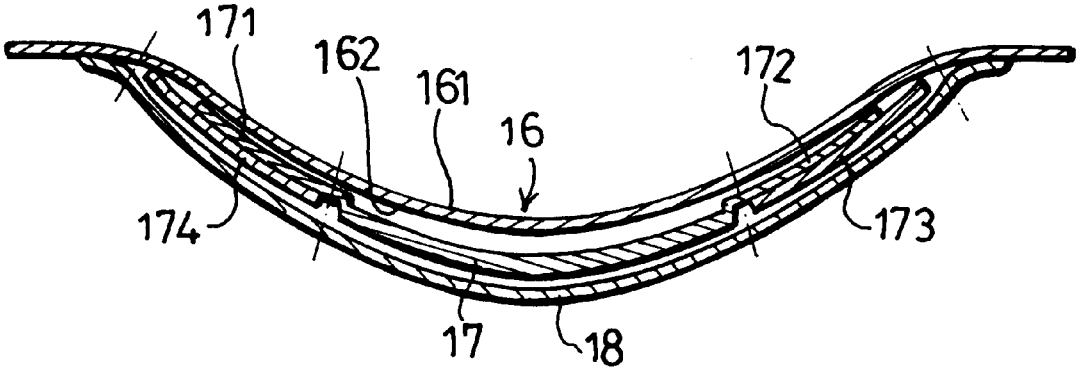
FIG. 4 is a sectional view of the preferred embodiment.

Referring to FIGS. 3 and 4, the preferred embodiment of a limb guard of this invention is used to protect a part of a limb from an external impact force and includes an elongate pad member 16, an elongate sheet layer 18, a one-piece shock absorbing member 17, and two elongate impact absorbing plates 173, 174.

As illustrated, the elongate pad member 16 is adapted to shield the part of the limb (not shown), and is adapted to extend in a lengthwise direction of the part of the limb. The pad member 16 has a rear surface 161 adapted to face the part of the limb, and a front surface 162.

The elongate sheet layer 18 is attached to the front surface 162 of the elongate pad member 16 at two longitudinal lateral end portions thereof so as to define an accommodation space between the elongate sheet layer 18 and the elongate pad member 16.

The shock absorbing member 17 is inserted in the accommodation space, and has a width smaller than a width of the elongate sheet layer 18. The shock absorbing member 17 includes a longitudinally extending central section 170 of a first thickness adapted to resist and consequently absorb the external impact force applied thereon, and two lateral wing sections 171, 172 which are integrally formed with and which extend laterally from two longitudinal edges of the central section 170. Each of the lateral wing sections 171, 172 has a second thickness smaller than the first thickness of the central section 170 to form a flexing juncture between the central section 170 and each of the lateral wing sections 171, 172. Thus, each of the lateral wing sections 171, 172 is adapted to flex toward the part of the limb relative to the central section 170 along a corresponding one of the flexing junctures to conform with and fit the contour of the part of the limb.

The preferred embodiment includes means for stitching together the elongate sheet layer 18 and the elongate pad member 16 along the flexing junctures to fix the central section 170 and the lateral wing sections 171, 172 on the elongate pad member 16. The stitching means divide the accommodation space into two lateral compartments 181 respectively accommodating the lateral wing sections 171, 172 therein, and an intermediate compartment 180 accommodating the central section 170 therein.

The impact absorbing plates 173, 174 are respectively disposed on the lateral wing sections 171, 172 of the shock absorbing member 17 so as to strengthen the shock absorbing capability of the lateral wing sections 171, 172.

Figure 5:
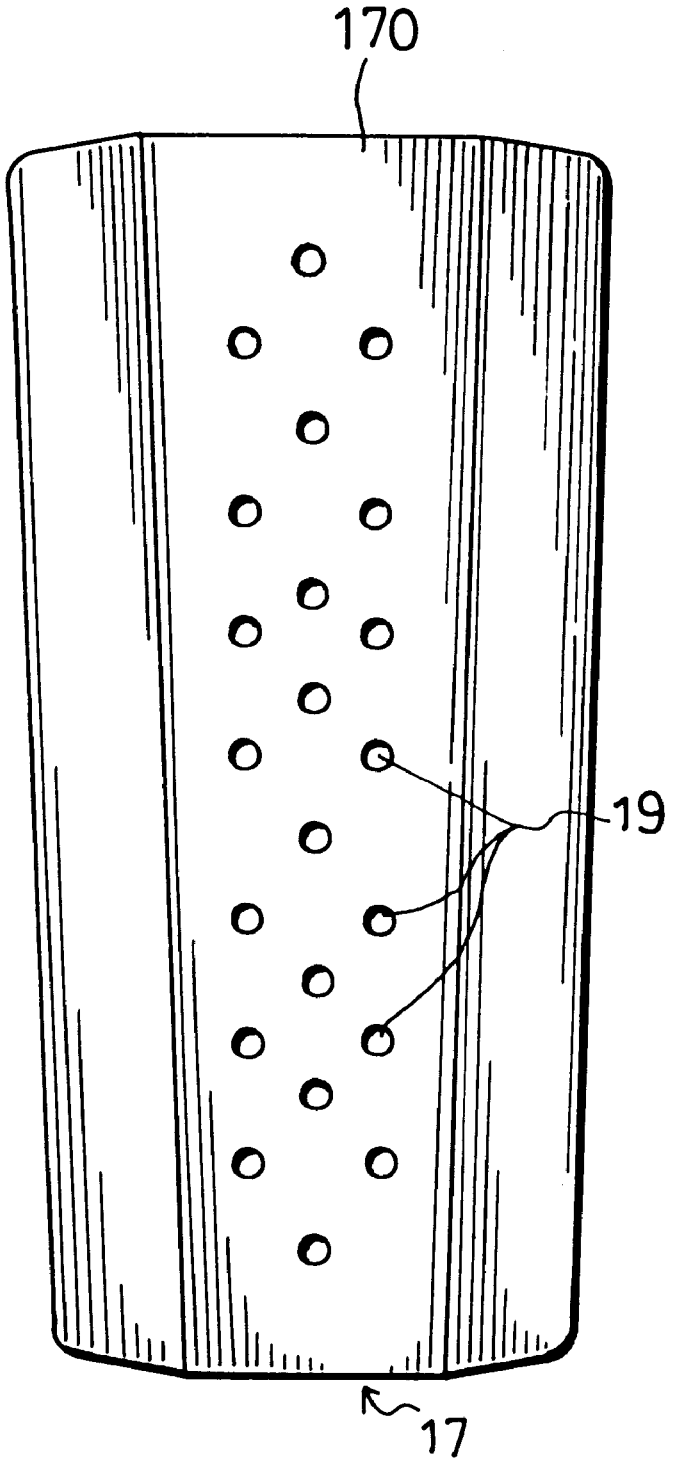
FIG. 5 is a schematic view of an impact absorbing member employed in the preferred embodiment.

Referring to FIG. 5, the central section of the shock absorbing member 17 has a plurality of vent-holes 19 formed therethrough to provide ventilation between the elongate pad member 16 and the shock absorbing member 17. The shock absorbing member 17 is preferably made of plastic and is produced generally by extrusion in a longitudinal form so that a desired length thereof can be cut off to suit the intended application.

With this invention thus explained, it is apparent that numerous modifications and variations can be made without departing from the scope and spirit of this invention. It is therefore intended that this invention be limited only as indicated in the appended claims.

I claim:

1. A limb guard for protecting a part of a limb from an external impact force, comprising:

an elongate pad member adapted to shield the part of the limb, and adapted to extend in a lengthwise direction of the part of the limb, said elongate pad member having a rear surface adapted to face the part of the limb, and a front surface;

an elongate sheet layer attached to said elongate pad member at two longitudinal lateral end portions thereof so as to define an accommodation space between said elongate sheet layer and said elongate pad member; and a one-piece shock absorbing member inserted in said accommodation space, and having a longitudinally extending central section of a first thickness adapted to resist and consequently absorb the external impact force applied thereon, and two lateral wing sections integrally formed with and extending laterally from two longitudinal edges of said central section and respectively of a second thickness smaller than said first thickness to form a flexing juncture between said central section and each of said lateral wing sections so that each of said lateral wing sections is adapted to flex toward the part of the limb relative to said central section along a corresponding one of said flexing junctures to conform with and fit contour of the part of the limb.

2. The limb guard as defined in claim 1, further comprising means for stitching together said elongate sheet layer and said elongate pad member along said flexing junctures to fix said central section and said lateral wing sections on said elongate pad member, thereby dividing said accommodation space into two lateral compartments respectively accommodating said lateral wing sections therein, and an intermediate compartment accommodating said central section therein.

3. The limb guard as defined in claim 1, further comprising two elongate impact absorbing plates respectively disposed on said lateral wing sections so as to strengthen shock absorbing capability of said lateral wing sections.

4. The limb guard as defined in claim 1, wherein said central section of said shock absorbing member has a plurality of vent-holes formed therethrough.

* * * * *